US009784071B2

(12) United States Patent
Byberg et al.

(10) Patent No.: US 9,784,071 B2
(45) Date of Patent: Oct. 10, 2017

(54) CASING ANNULUS CEMENT FOUNDATION SYSTEM AND A METHOD FOR FORMING A FLANGE COLLAR CONSTITUTING A CEMENT FOUNDATION

(71) Applicant: ARCHER OILTOOLS AS, Stavanger (NO)

(72) Inventors: Arve Byberg, Klepp stasjon (NO); Arve Bådsvik, Tananger (NO)

(73) Assignee: ARCHER OILTOOLS AS, Stavanger (NO)

( * ) Notice: Subject to any disclaimer, the term of this patent is extended or adjusted under 35 U.S.C. 154(b) by 247 days.

(21) Appl. No.: 14/622,375

(22) Filed: Feb. 13, 2015

(65) Prior Publication Data

US 2016/0208577 A1 Jul. 21, 2016

(30) Foreign Application Priority Data

Jan. 19, 2015 (NO) ..... 20150089

(51) Int. Cl.
*E21B 33/14* (2006.01)
*E21B 34/14* (2006.01)
(Continued)

(52) U.S. Cl.
CPC ..... *E21B 34/14* (2013.01); *E21B 33/128* (2013.01); *E21B 33/14* (2013.01); *E21B 33/16* (2013.01); *E21B 2034/007* (2013.01)

(58) Field of Classification Search
CPC ..... E21B 34/14; E21B 33/128; E21B 33/16; E21B 33/14; E21B 2034/007;
(Continued)

(56) References Cited

U.S. PATENT DOCUMENTS 2,925,865 A 2/1960 Oliver
3,148,731 A 9/1964 Holden
(Continued)

FOREIGN PATENT DOCUMENTS

WO WO 91/05134 A1 4/1991
WO WO 02/04783 A1 1/2002
WO WO 2004/027201 A2 4/2004

*Primary Examiner* — Brad Harcourt

(74) *Attorney, Agent, or Firm* — Birch, Stewart, Kolasch & Birch, LLP

(57) ABSTRACT

A method for forming a flange collar constituting a cement foundation in a casing annulus, includes the steps of installing a casing section comprising an internal sleeve axially displaceable by a conveyed tool for opening a casing cementing outlet; the internal sleeve connected through radial bolts through axial-parallel slots through the casing wall to a casing-external sleeve, the casing-external sleeve abutting against a first edge of a deformable metal sleeve having its opposite, second end abutting axially against a radial shoulder on the casing section; using the drill pipe conveyed tool for axially displacing the internal sleeve thus forcing the external sleeve to deforming the metal sleeve to a radially extending flange collar radially extending across the casing annulus, and ejecting cement via the casing cementing outlet to the annulus, allowing the cement to distribute above the formed radially extending flange collar, and allowing the cement to settle in the annulus.

11 Claims, 14 Drawing Sheets drop ball, close circulation (by-pass not shown), increase pressure P, break plug to annulus.

(51) Int. Cl.

| | |
|---|---|
| ***E21B 33/128*** | (2006.01) |
| ***E21B 33/16*** | (2006.01) |
| *E21B 34/00* | (2006.01) |

(58) Field of Classification Search
CPC ..... E21B 33/12; E21B 33/1212; E21B 33/13; E21B 33/146
See application file for complete search history.

(56) References Cited

U.S. PATENT DOCUMENTS

| | | | | |
|---|---|---|---|---|
| 3,527,299 | A | 9/1970 | Lewis | |
| 3,948,322 | A | 4/1976 | Baker | |
| 5,024,273 | A | 6/1991 | Coone et al. | |
| 5,738,171 | A | 4/1998 | Szarka | |
| 7,234,533 | B2 | 6/2007 | Gambier | |
| 2006/0186602 | A1* | 8/2006 | Martin | E21B 17/07 277/338 |
| 2009/0084553 | A1* | 4/2009 | Rytlewski | E21B 34/06 166/305.1 |
| 2010/0051276 | A1 | 3/2010 | Rogers et al. | |
| 2011/0062670 | A1 | 3/2011 | Allen | |
| 2012/0261127 | A1 | 10/2012 | Zhou | |

* cited by examiner

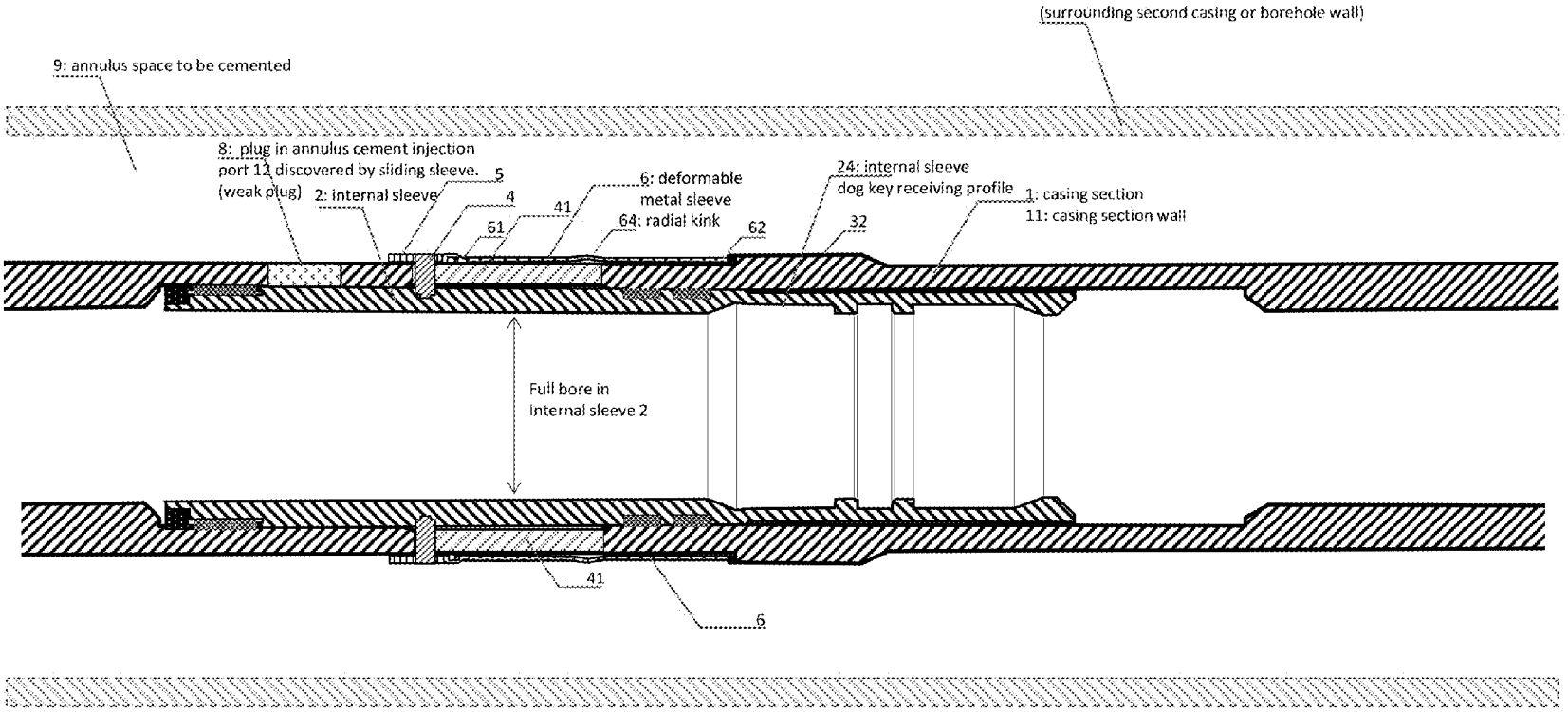
Fig. 1: prearranged casing section with prepared deformable metal sleeve

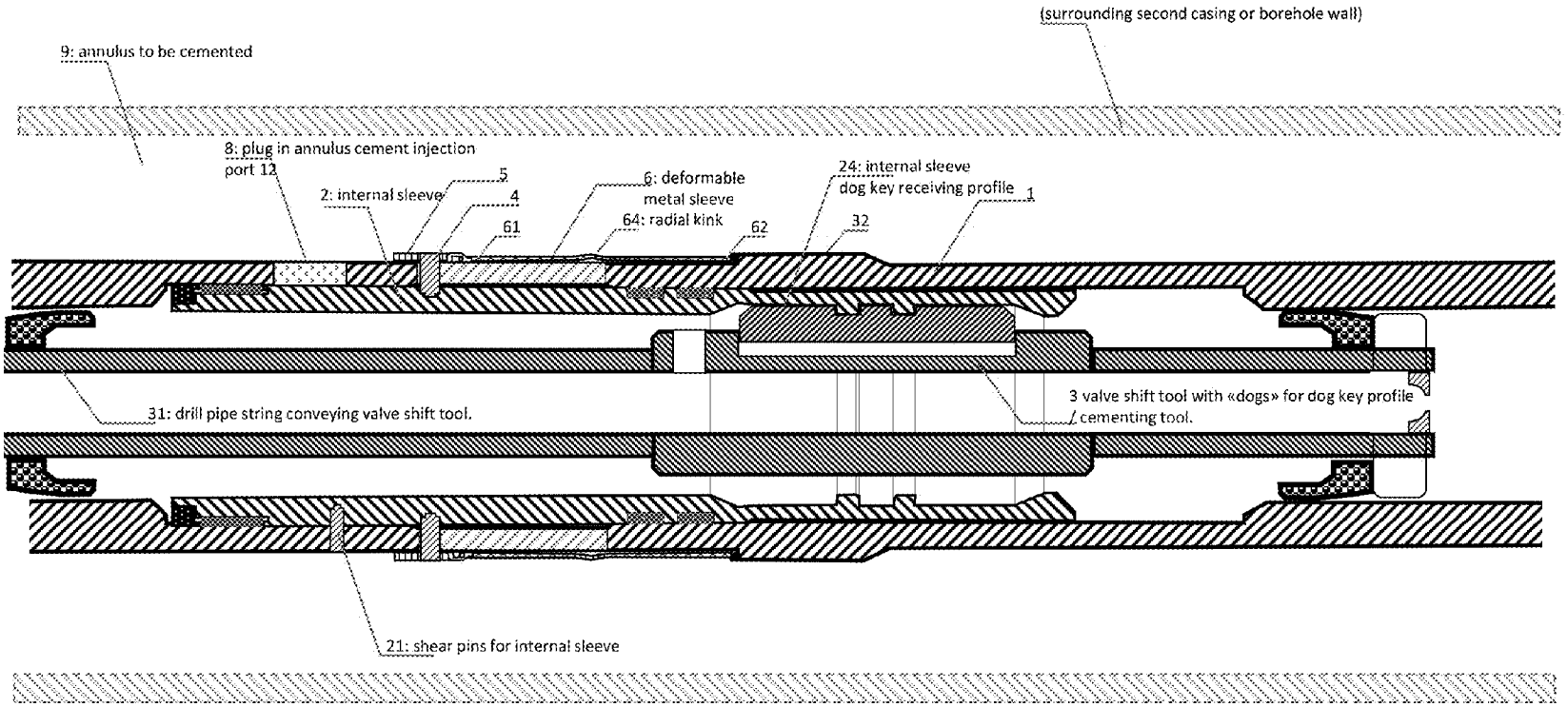
Fig. 2: insert pipe string conveyed valve shift tool, lock into dog key receiving profile.
(Please notice that bypass line past swab cups is not illustrated).

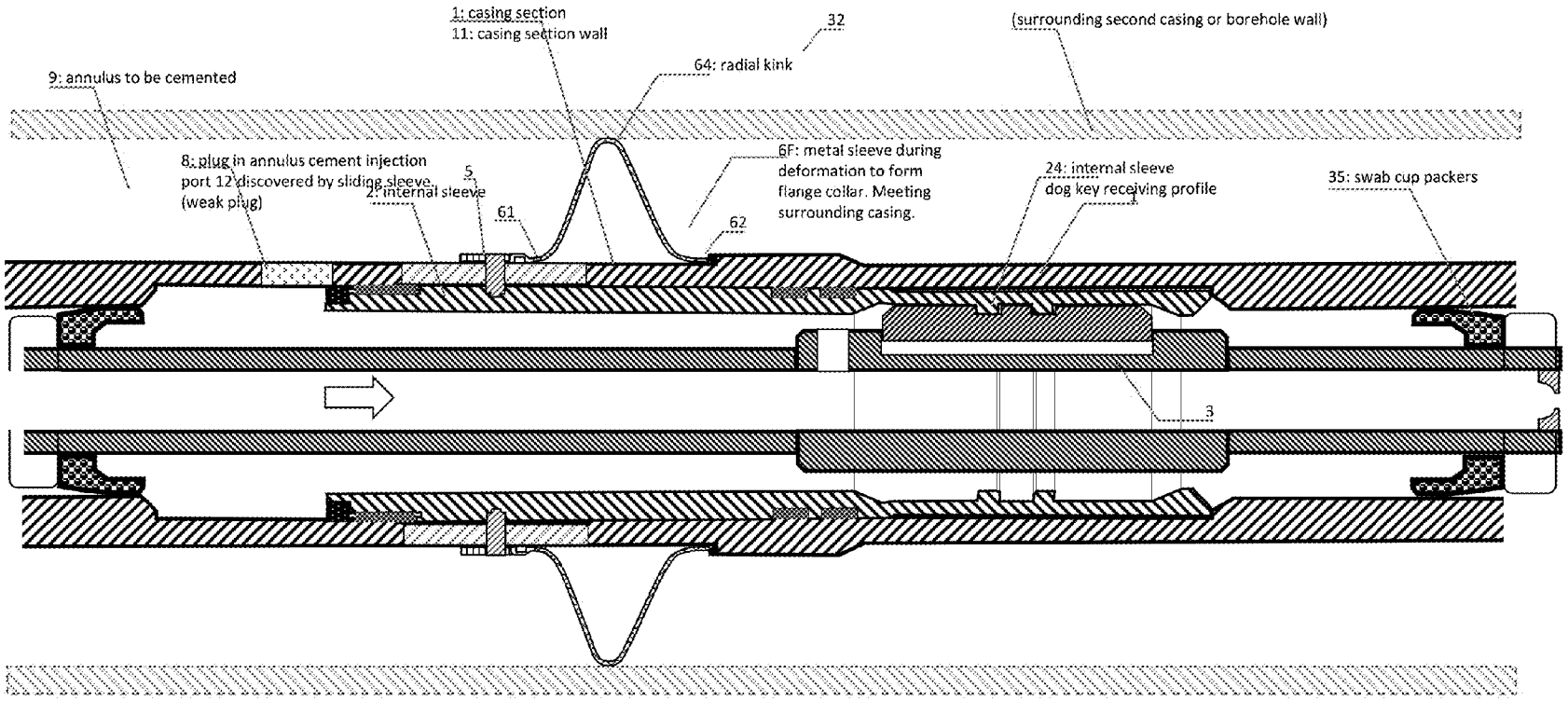
Fig. 3a: moving valve shift tool, expanding straight sleeve to form flange collar

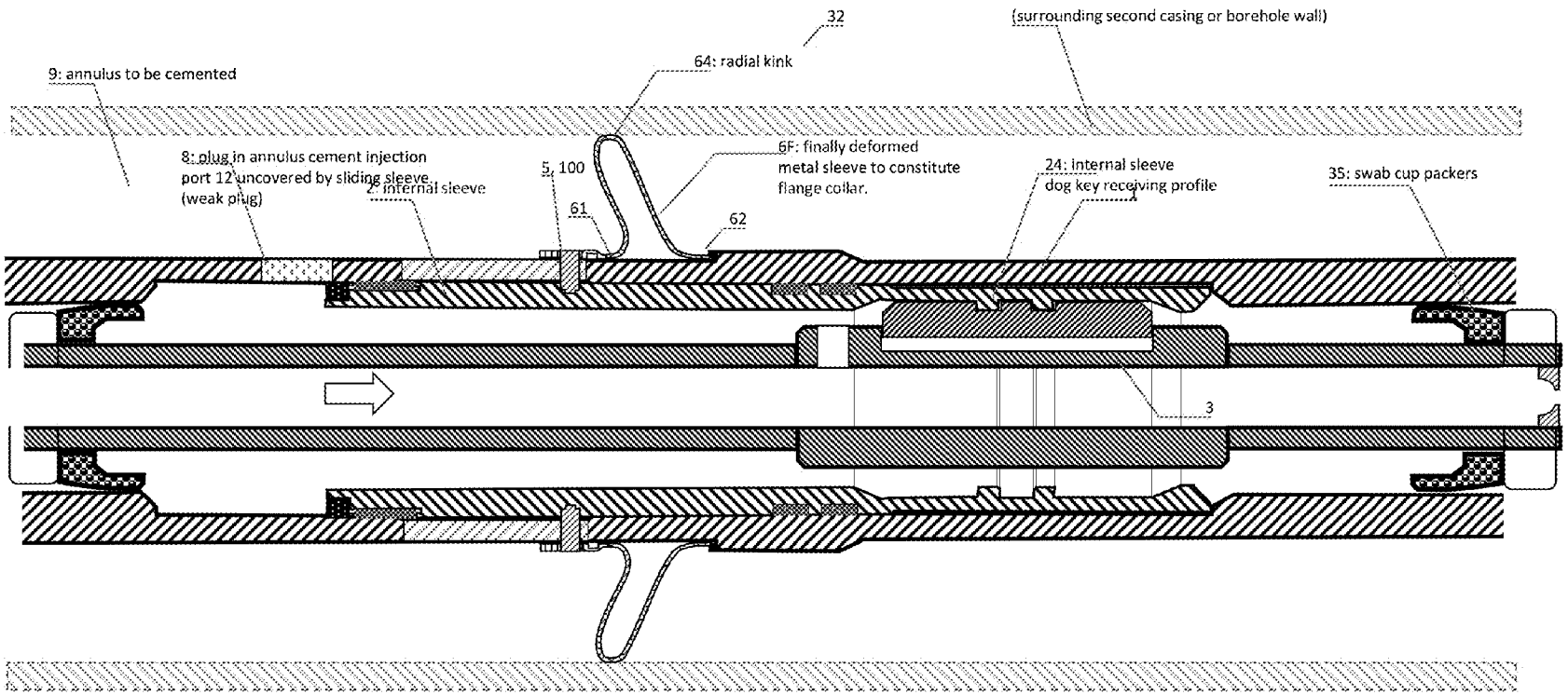
Fig. 3b: moved valve shift tool, flange collar formed

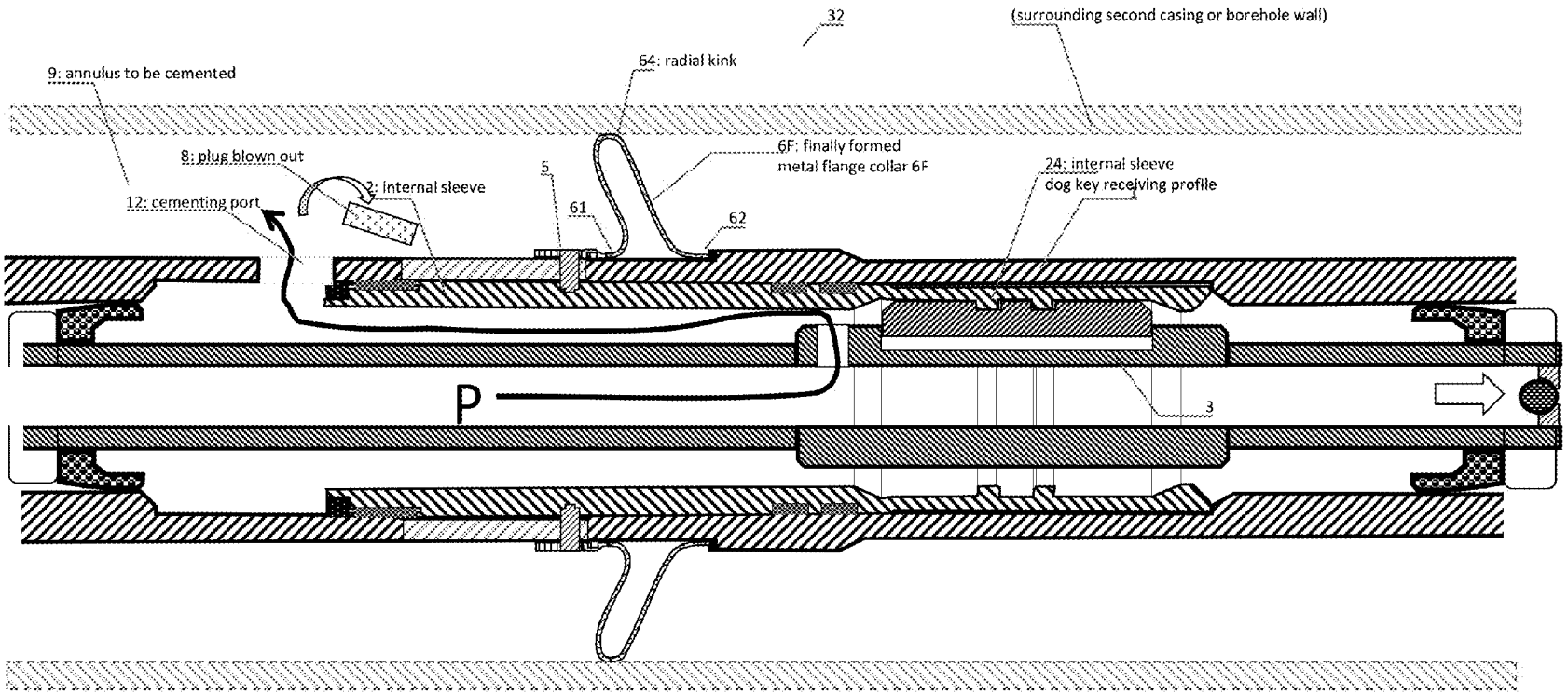
Fig. 4: drop ball, close circulation (by-pass not shown), increase pressure P, break plug to annulus.

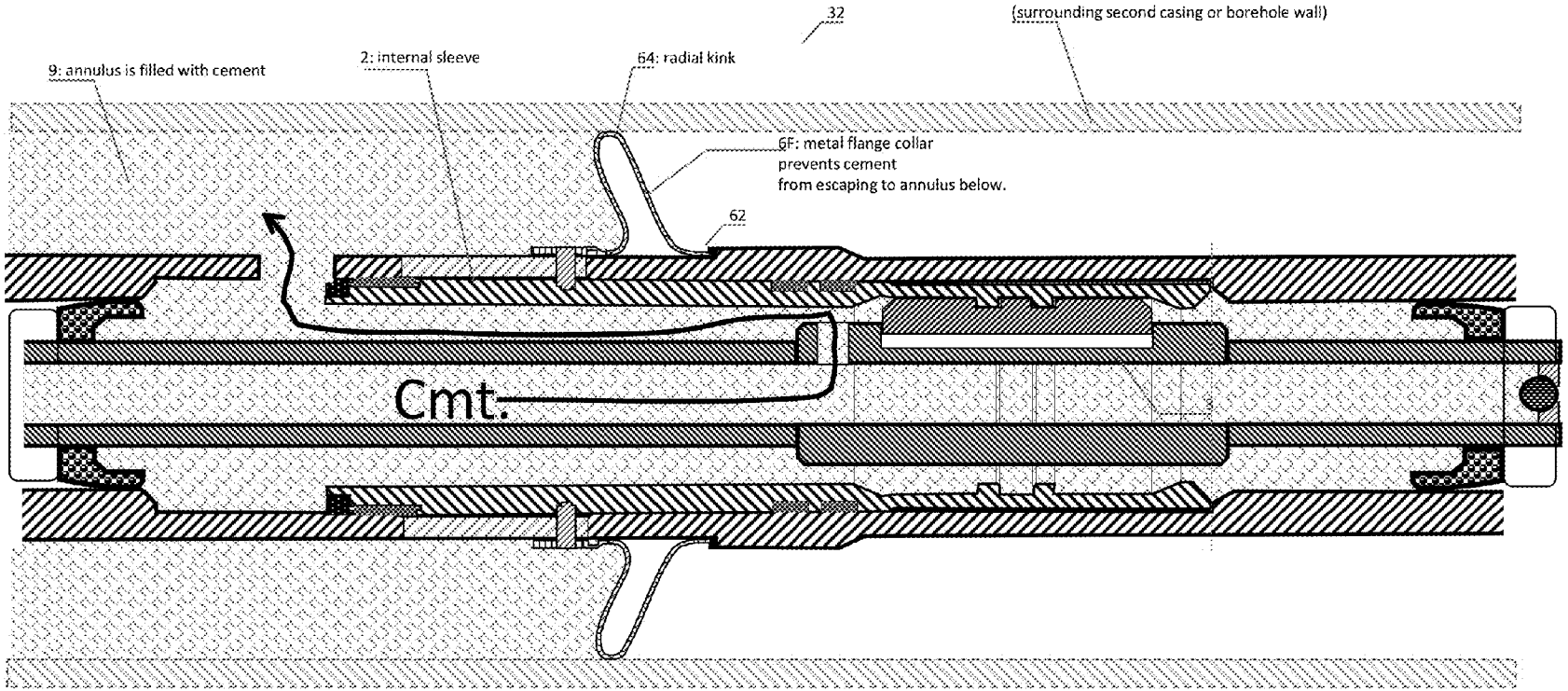
Fig. 5: inject cement slurry via drill pipe string and valve shift tool cmt port.

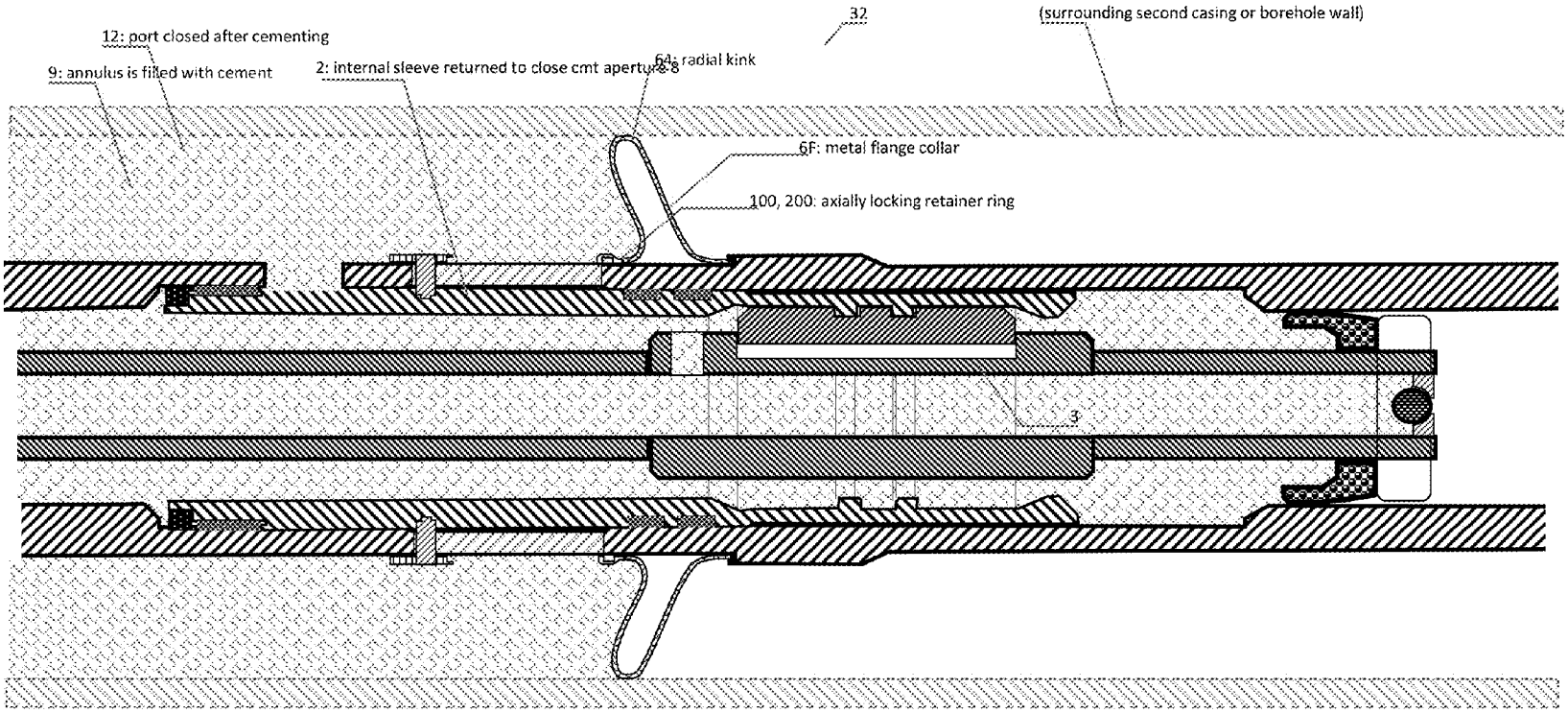
Fig. 6: move tool to return sleeve to close port.

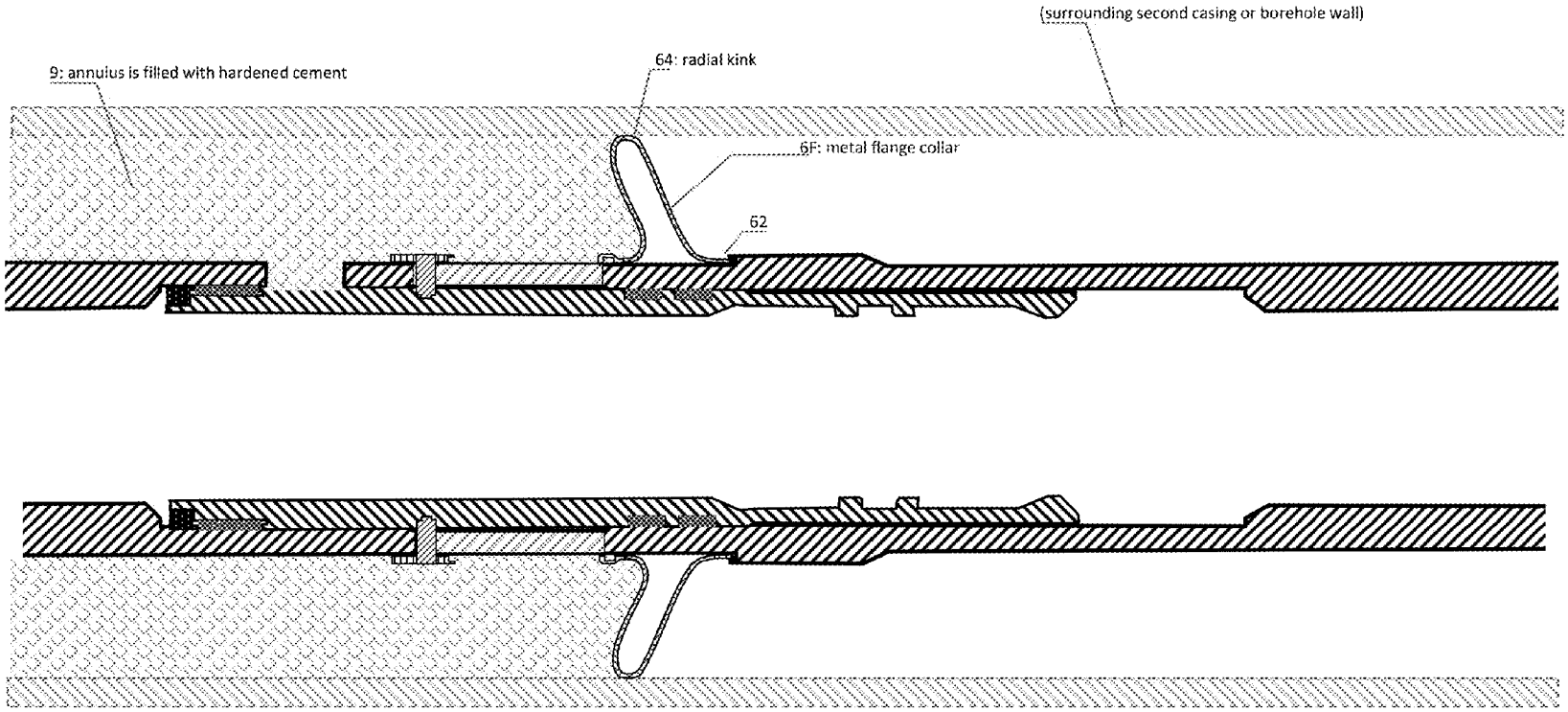
Fig. 7: circulate out excess cement in central casing, rotate and pull to release from key profile, and remove tool.
Result of operation: Casing annulus is now cemented above the collar.

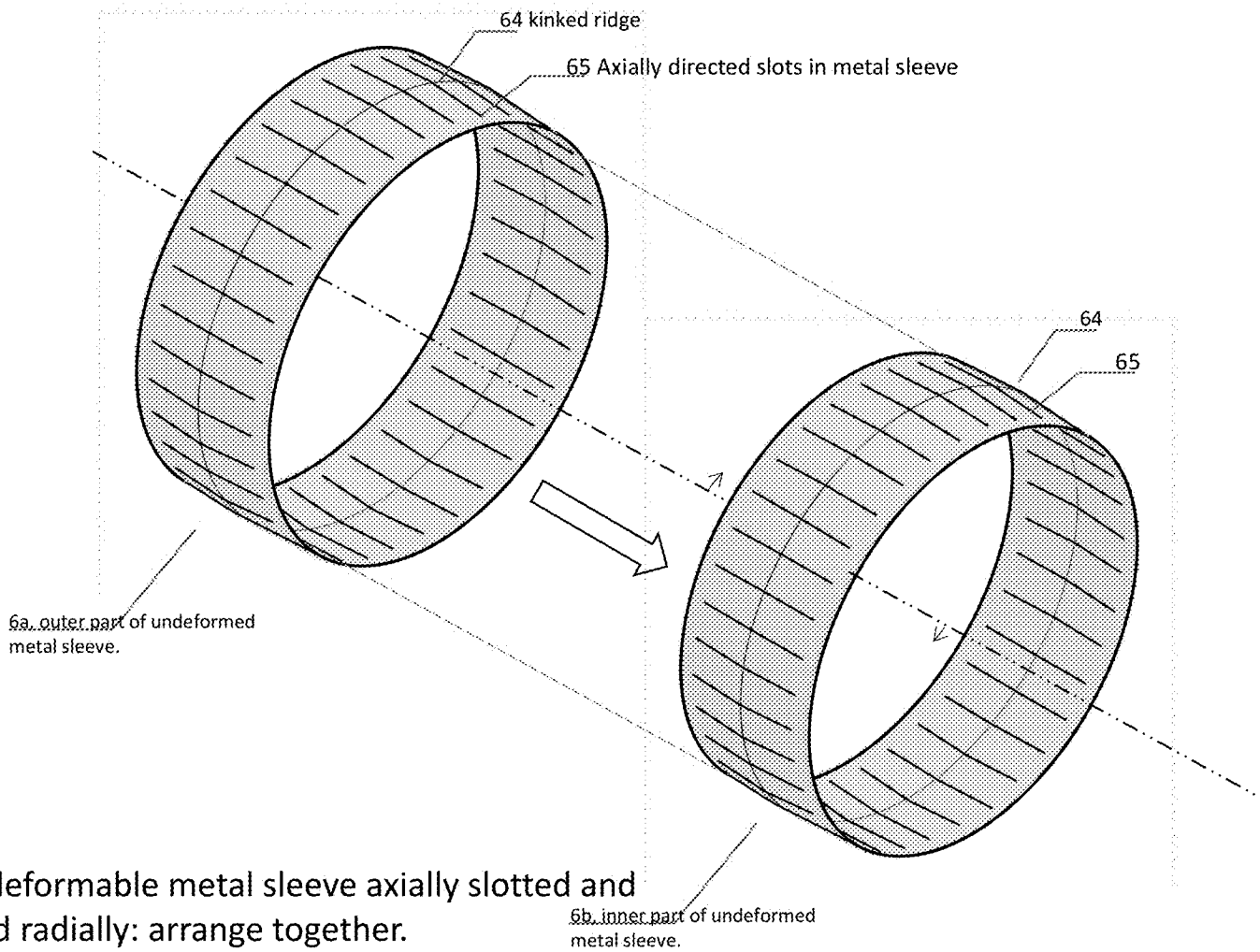
Fig. 8: deformable metal sleeve axially slotted and doubled radially: arrange together.

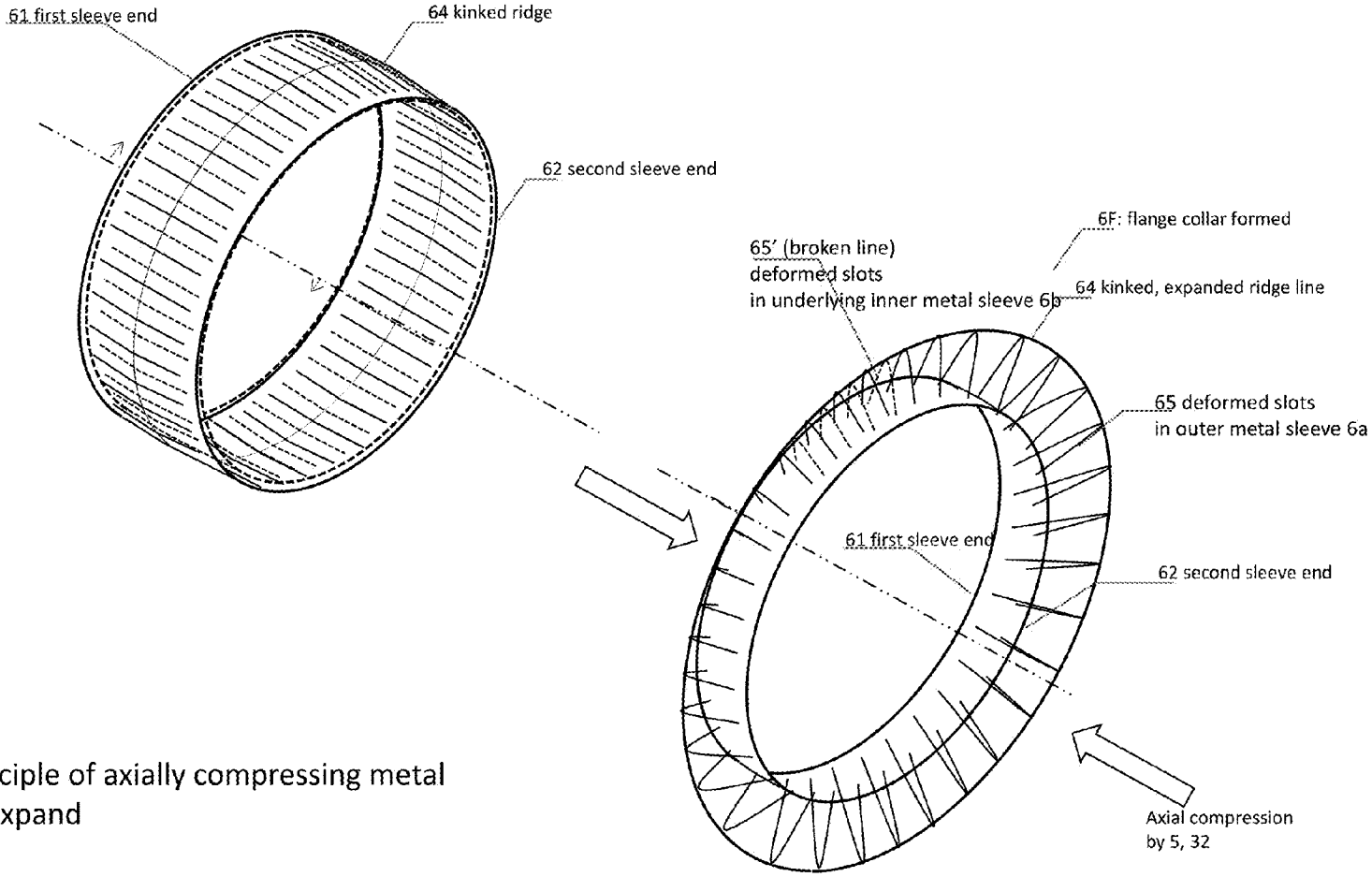
Fig. 9: principle of axially compressing metal sleeve to expand

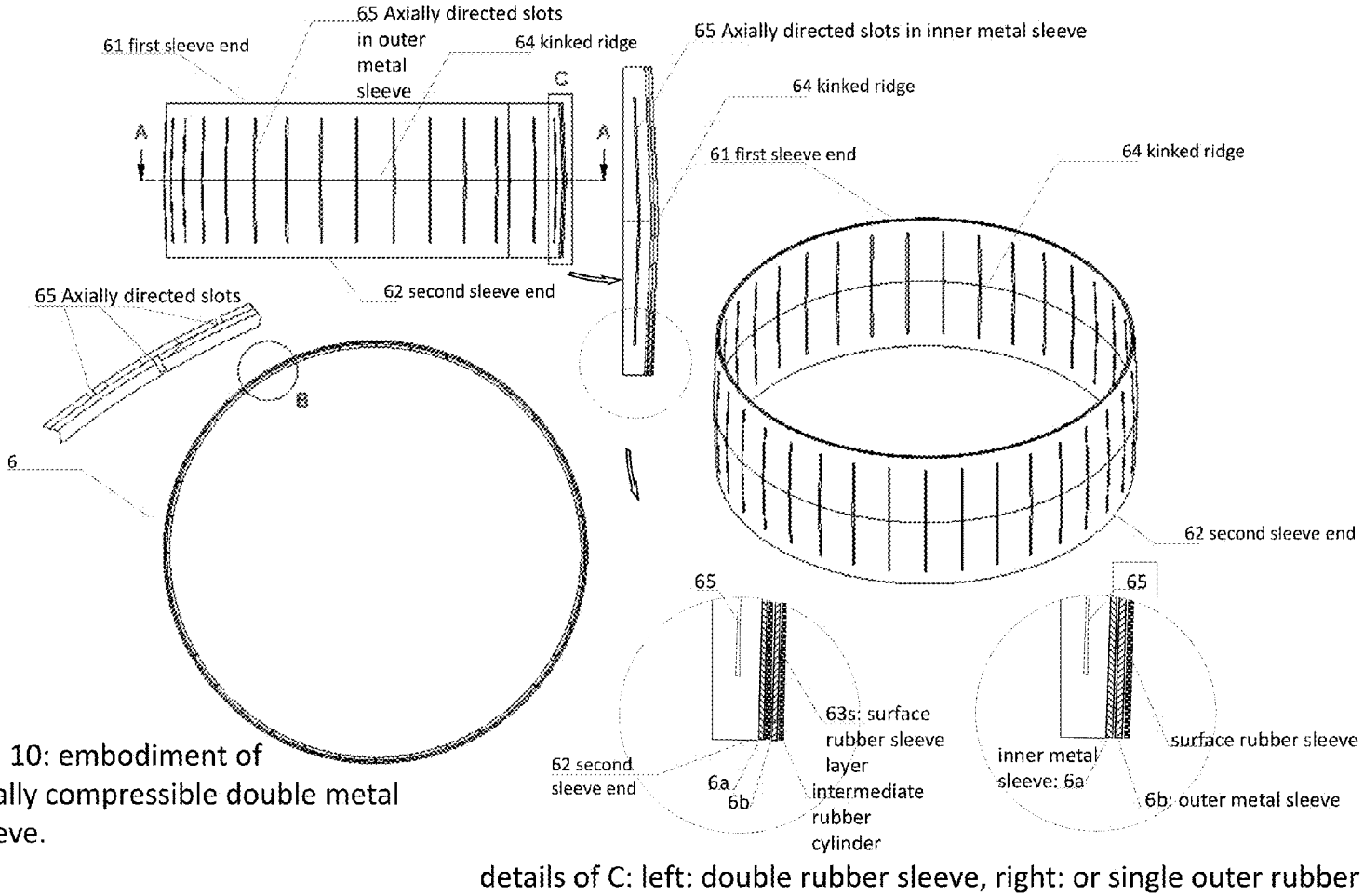
details of C: left: double rubber sleeve, right: or single outer rubber sleeve
Fig. 10: embodiment of axially compressible double metal sleeve.

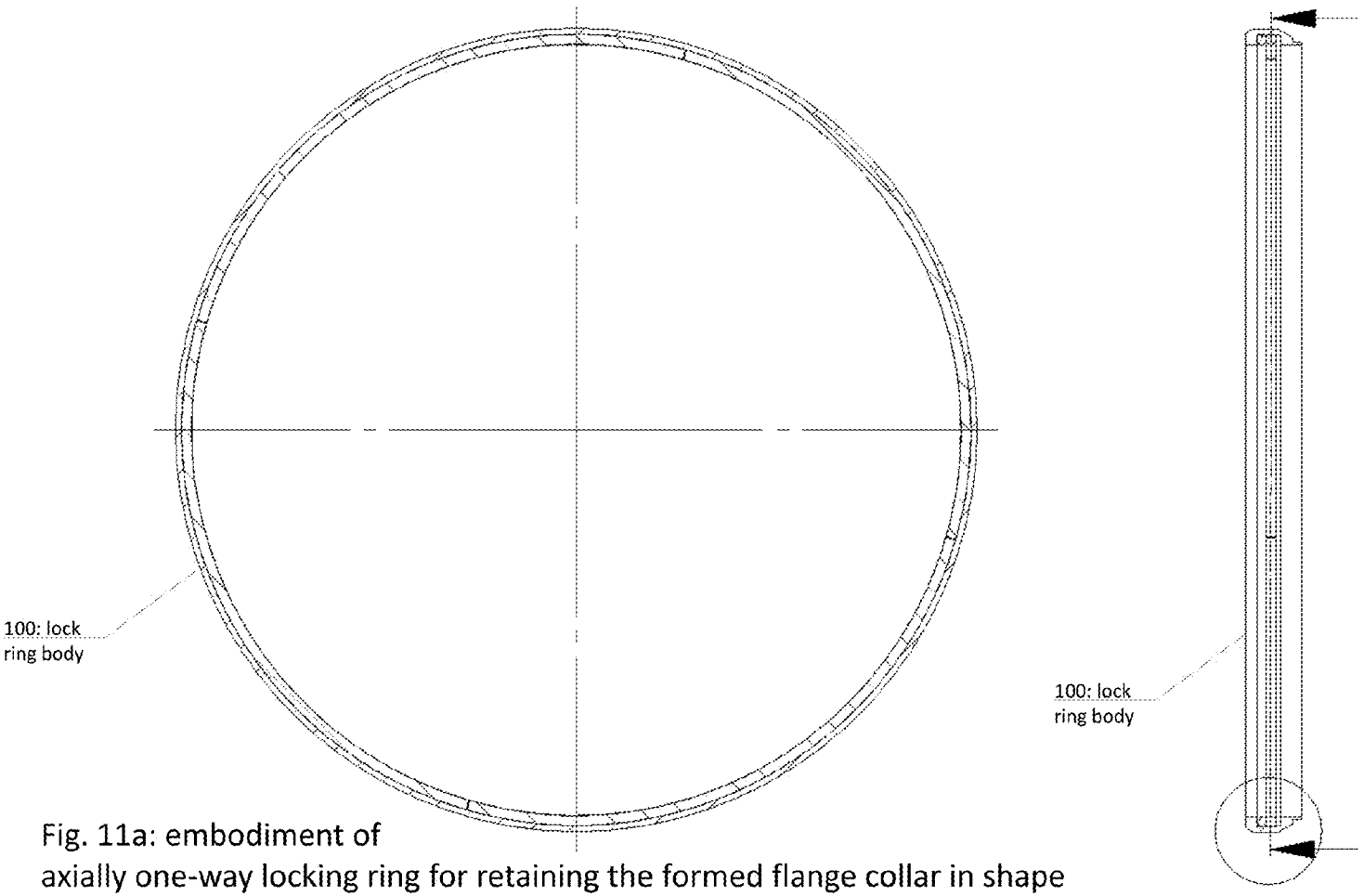
Fig. 11a: embodiment of axially one-way locking ring for retaining the formed flange collar in shape and in contact with the surrounding wall encountered when expanded to flange collar.

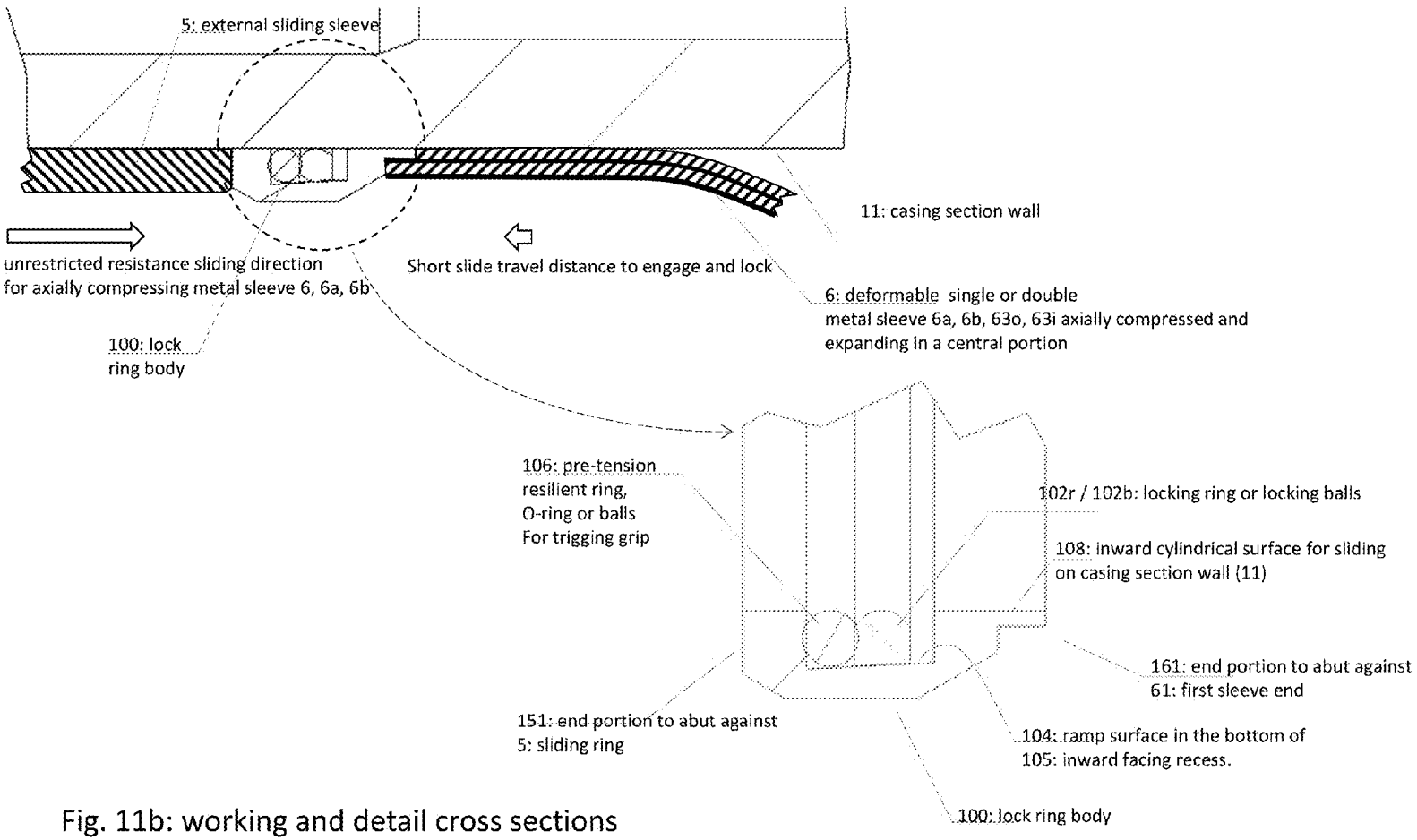
Fig. 11b: working and detail cross sections of axially one-way lock ring (100).

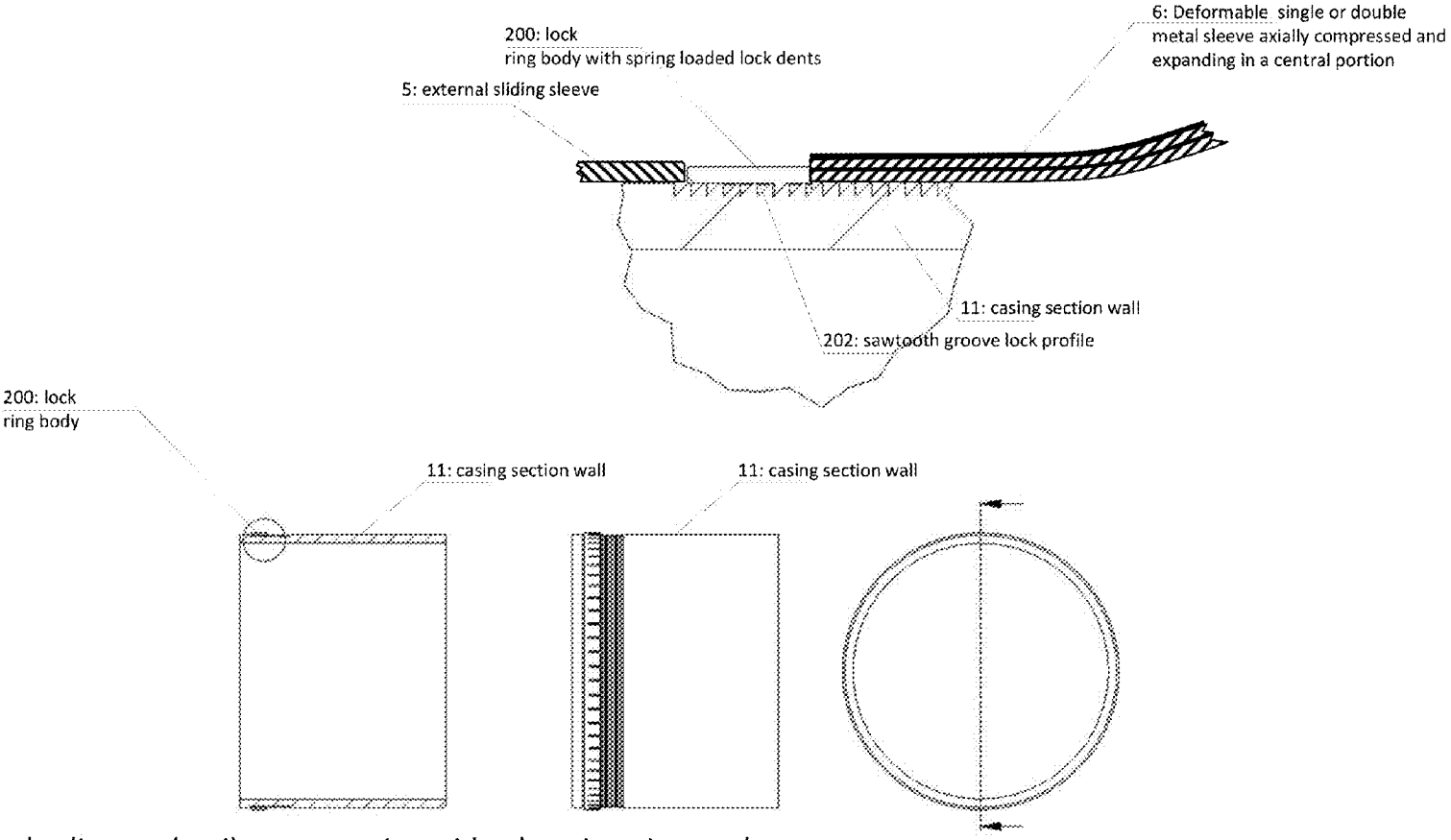
Fig. 12: embodiment detail, cross-section, side elevation view and end view of casing section with axially one-way sawtooth groove lock ring.

CASING ANNULUS CEMENT FOUNDATION SYSTEM AND A METHOD FOR FORMING A FLANGE COLLAR CONSTITUTING A CEMENT FOUNDATION

FIELD OF THE INVENTION

The present invention relates to the technical field of petroleum well construction. More specifically, the invention relates to a tool for cementing in the annulus outside a casing pipe in the well. The annulus may be between the casing and a surrounding borehole wall which shall be cemented. The annulus may also be between the inner casing and a surrounding second casing.

The purpose of the present invention is to establish an annulus barrier and inject cement above it at a desired level in a casing annulus about a modified so-called Cflex-casing section as illustrated in an embodiment in FIG. 5. After cement injection into the annulus it is required to retract and close the sleeve valve and the tool, circulate to wash out remaining cement in the casing sleeve, and allow the cement in the annulus to set and harden. With the shift and cementing tool pulled out of hole there remains a full bore passage past the now cemented casing section.

BACKGROUND ART

U.S. Pat. No. 7,234,533 to Gambier discloses a seal assembly maintaining a seal under various conditions by storing energy that can be used to insure maintenance of the contact forces of the seal. It is a seal element for use in a packer deployed in a well, comprising a support sleeve, a sealing layer enclosing the support sleeve, and a tube with slots adapted to radially extend against the above mentioned support sleeve in response to the tube being axially compressed to press the sealing layer against a wall enclosing the packer to establish a sealing contact between the sealing layer and the well.

US2012/0261127 Saudi Arabian Oil Company describes a sliding stage cementing tool and method wherein an inflatable packer is inflated by injection from fluid in an annular cylinder. Check valves keep the packer inflated after the injection. The inflatable packer forms a cementing foundation in the annulus.

WO91/05134 and U.S. Pat. No. 5,024,273 Coone, "Cementing apparatus" describes a cementing tool for placing cement within the annulus between a casing string and a well bore. A stage collar has a packing element which is inflatable by a liquid provided through narrow passageways.

U.S. Pat. No. 3,948,322 describes a multiple stage cementing tool with an oil-inflatable packer forming a basis in the annulus for cementing.

US2010/0051276 Rogers et al. describes a stage cementing tool for use in cementing a casing in a well. The stage cementing tool includes a housing with a mechanically set packer so seal against the well. A hydraulically actuated opening sleeve will move in the housing to uncover flow ports in the housing and allow flow therethrough into the well. An end ring 66 is arranged for being displaced so as for compressing a rubber packer axially, resulting in the rubber packer expanding radially to close the annulus.

The cementing tool of Rogers has a packer assembly for being set mechanically and a second stage cementing sleeve which is set hydraulically. A cementing plug is landed in a seat in the cementing sleeve, hydraulic pressure is then used to move the cementing sleeve.

Disadvantages of Rogers' stage cementing tool are:

Activation using a cementing plug which must be drilled out after the cementing operation.

Moreover, a significant disadvantage of Rogers' device is that once the cementing process is complete, the sleeves and seats which present obstacles in the full-bore diameter of the casing, and/or cement in the casing, must be drilled out before further operations may be carried out.

The design requires much space, which is a problem if the cementing collar shall have the same pressure rating as the casing.

The radial reach of the compressed seal element is rather small as the radial expansion is due to axial compression only. This will strongly limit the usefulness to other than cementing into a small inner diameter of a surrounding casing. Due to this point and the space requiring design mentioned above, this will incur an increased dynamic counterpressure during circulation in the annulus.

When the plug is set, a pressure increase will activate the mechanism, a step which cannot be undone.

U.S. Pat. No. 5,738,171 Szarka, Halliburton, describes well cementing inflation packer tools and methods. The tool includes a tubular housing with a packer inflating port and a packer inflating port opening sleeve sliding within the housing. The opening sleeve is moveable between closed and opening positions by a cementing plug. An external packer sleeve has a pressurized fluid inflatable packer element and a cement port in it is sealingly arranged over the outer surface of the housing and the packer inflating port. The external packer sleeve has a passageway from the packer inflating port to the inflatable packer element and a check valve in the passageway. A fluid rupturable port has a predetermined rupture pressure sealingly arranged over the cementing port. Cement may be filled into the packer.

A casing cementing system called C-flex, which is marketed by the applicant Archer Oil Tools, comprises a casing section with an internal sleeve operated valve to the annular space. The internal sleeve and aperture are provided with gaskets so as to make the Cflex casing section gas proof. The sleeve is operated to open and close from within the casing bore by a drill pipe string mounted manipulation tool with a set of "dogs" protruding from the tool stem. The set of dogs of the drill pipe string conveyed tool engages with a corresponding key ring of the correct dimension within the internal sleeve. When the sleeve is displaced the valve to the annulus is opened so as for cement to be injected from a port in the tubular tool stem out into the casing and subsequently out through the opened valve. So-called swab cups prevent cement from extending along the tool stern in the interior of the casing. The combined manipulating and cementing tool with swab cups is very similar to the wash tools shown in Nelson's (Schlumberger) 2006 textbook "Well Cementing", p. 530 and FIG. 14-34 in chapter 14 on "remedial cementing".

Such C-flex casing sections may be installed in the casing string in several places for immediate use after the installation of the casing, or for potential subsequent remedial cementing.

Problem to be Solved

A problem related to cementing a casing string is to avoid loss of cement. There is often no foundation for the cement below the section to be cemented, either in the casing to rock annulus or the casing to second casing annulus. If the density of the existing annular fill-in material is lower than the cement, the cement may be lost downwardly. An elastically expandable gasket may be inflated about the casing but is vulnerable to puncture and deformation incurring loss of cement, and thus loss of a foundation of cement.

BRIEF FIGURE CAPTIONS

The present invention is illustrated in the attached drawing Figures.

FIG. 1 illustrates a casing section according to the invention provided with a deformable metal sleeve arranged on the outer face of the casing section.

FIG. 2 illustrates the casing-internal manipulation tool inserted into the sleeve of the casing section of the invention.

FIG. 3*a* illustrates the drill pipe conveyed tool shifting the inner sleeve downwards. An external ring (5) is brought along with the inner sleeve, and buckles out a deformable metal sleeve (6) to form a collar which deforms radially outwards until it abuts against the surrounding casing.

FIG. 3*b* illustrates the further formed metal flange collar.

FIG. 4 snows a ball being circulated down the drill pipe string, closes below the shifting tool, and the plug (8) blown out by the pressure.

FIG. 5 shows cement being injected through the drill pipe string.

FIG. 6 shows the shift tool closing the valve.

FIG. 7 shows the result: the casing annulus is now cemented above the collar.

FIG. 8 illustrates an embodiment of the deformable metal sleeve having axially directed slots.

FIG. 9 illustrates the combined slotted sleeve from FIG. 8 in original and axially compressed, radially expanded form.

FIG. 10 illustrates the combined slotted sleeve in part view and section (A), enlarged section (C) of (A), Section (B) as indicated in A-A in (A), enlarged section of (B), and a perspective view.

FIG. 11*a* comprises illustrations of a locking ring for retaining the formed flange collar in position when axially compressed.

FIG. 11*b*: illustrates working and detail cross sections of the axially one-way locking ring.

FIG. 12 illustrates an alternative axially one-way locking ring with a transverse groove lock profile.

SHORT SUMMARY OF THE INVENTION

A main object of the present invention is to disclose a tool and a method for easily establishing a foundation for the annular cement injection. The tool of the invention is based on the above mentioned Cflex system. A casing pipe internal sleeve is displaceable for a short distance along the inner wall of the casing pipe by a drill pipe string conveyed tool. A casing external ring is connected with radial bolts through axial-parallel slots through the casing wall. A thin deformable metallic sleeve is arranged about the casing's perimeter and abuts with the mobile external ring along one of its edges. Along the opposite edge of the deformable metal sleeve it abuts against a shoulder ring on the outer face of the casing. When the internal sleeve is axially displaced in the direction towards the shoulder ring, the thin metallic sleeve is axially compressed and deforms by kinking out radially to abut with the borehole wall or whatever surrounds the casing. The kinked-out expanded metal sleeve then forms a collar closing the annulus in the axial direction of the borehole. The expanded metal collar thus forms a foundation for cement. Depending on the metal type and dimensions of the sleeve, the so formed collar may withstand a pressure difference of about 25 Bar which should prove a good basis for cement injection.

The invention is defined in claim terms as indicated in claim 1.

Embodiments of the Invention

The invention will in the following be described and embodiments of the invention will be explained with reference to the accompanying drawings.

The invention is a casing annulus cement foundation system comprising:

A casing section (1) comprising an internal sleeve (2) arranged for being manipulated by a conveyed shift tool (3) exerting a force for translating said internal sleeve (2) in an axial direction of said casing section (1). The shift tool (3) is drill pipe string conveyed in the described embodiment of the invention. The internal sleeve (2) is provided with one or more radially directed bolts (4) extending through corresponding axial-parallel slots (41) through the casing wall (11) of said casing section (1) and fixed to a corresponding sliding casing-external sleeve (5). In other words, the internal sleeve (2) is connected to the external casing sleeve (5) via bolts (4) through the casing section (1) wall (11), and the bolts may slide in axially directed slots (41). The slidable casing-external sleeve (5) abuts axially onto a deformable metal sleeve (6) which again is held by an external ring shoulder (32). More specifically, the external sleeve (5) abuts onto a first sleeve end (61) of a deformable metal sleeve (6) having a second sleeve end (62) abutting onto an external ring shoulder (32) on the casing section (1). The sliding casing-external sleeve (5) is arranged for axially compressing said deformable metal sleeve (6) so as for making a central portion between the first and second ends (61, 62) to expand by radial kinking to form a metal flange collar (6F) blocking said casing annulus against a wall such as another casing or a borehole wall. Other radial expansion such as by bulging is imagined.

In an embodiment of the casing annulus cement foundation system, the deformable metal sleeve (6) is provided with an initial radial kink (64) so as for forming a trace for which said radial kink (64) may start developing said flange collar (6F) under said axial compression of said deformable metal sleeve (6).

In an embodiment of the casing annulus cement foundation system described above, the deformable metal sleeve (6) is ductile and non-resilient, so as to retain its deformed shape as a flange collar (6F) when unloaded from said external sleeve (5). There will always be some hysteresis when unloaded but this may be negligible. The In this manner, the internal sleeve may hp retracted by the valve shift tool (3) after the cement injection through ports (12), please see FIG. 6.

In an embodiment of the invention, there is arranged with the internal sleeve (2) a ratchet lock (22) arrangement along the inner wall of said casing section (1). The ratchet lock preventing undesired axial displacement return from the activated position of the internal sleeve (2).

In an embodiment of the invention the casing sleeve comprises one or more cementing outlets (12) through said casing section wall (11) for cement ejection, said cementing outlets (12) exposed by said internal sleeve (2) when said internal sleeve is axially displaced, and closed when not axially displaced, so as for allowing cement to be ejected to said casing annulus.

The invention is also a method for forming a flange collar on a casing section, said flange collar for cementing an annulus. More specifically, the invention is a method for forming flange collar for forming a cement foundation in a casing annulus, comprising the steps of:

installing a casing section (1) comprising an internal sleeve (2), said internal sleeve axially displaceable by a conveyed tool (3) preferably drill pipe string conveyed, said internal sleeve (2) connected through radial bolts (4) through axial-parallel slots (41) through the casing wall to a casing-external sleeve (5), said casing -external sleeve (5) abutting against a first edge (61) of a deformable metal sleeve (6) having its opposite, second end abutting axially against a radial shoulder (32) on the casing section (1);

using said drill pipe conveyed tool (3) for axially displacing said internal sleeve (2) thus forcing said external sleeve (5) against said first edge (61) thus deforming said metal sleeve (6) to a radially extending collar extending across said casing annulus.

The workings of the invention is now explained with reference to the drawing Figures.

FIG. 1 illustrates a casing section (1) according to the invention provided with a deformable metal sleeve (6) arranged on the outward cylindrical face (11) of the casing section (1) and connected movable by means of with an inner sleeve (2) which may be actuated and moved by a casing-internal manipulation tool such as a so-called "Cflex-tool" conveyed on a drill pipe string (3).

FIG. 2 illustrates the casing-internal manipulation tool (3) inserted into the sleeve of the casing section of the invention. The drill pipe string (31) conveyed tool (3) is preferably the same as used for Archer Oil Tools Cflex system and comprises a hollow stem with a cementing port to the casing, and a dog arranged to engage with a dog key receiving profile of the internal sleeve. Swab cups for isolating the internal of the casing are arranged above and below the cementing outlet on the stem of the tool.

The inner sleeve (2) may be held in the initial closing position by a desired number of shear pins (21) well known in the art in order for keeping a cementing port (12) closed. The shear force may be in the range of 7-10-15 metric tons in order to start shifting the internal sleeve (2).

FIG. 3*a* illustrates the drill pipe conveyed tool shifting the inner sleeve (2) downwards. An external ring (5) is brought along with the inner sleeve (2), and axially compresses, thus buckles out the deformable metal sleeve (6) to start forming a flange collar which expands radially outwards until it abuts against the surrounding casing's inner wall. So far the deformation of the two slopes of the deforming metal sleeve (6, 6F) will occur more or less symmetrically, before the radially outer kink's (64) edge encounters the inner wall of the surrounding casing or borehole wall.

FIG. 3*b* illustrates the further deformation after the outer edge of the flange collar (6F) has encountered the surrounding casing wall. The further deformation will now generally occur asymmetrically, with more deformation occurring at the sliding ring (5) encountering part (61) of the deformed metal flange collar (6F). The so formed flange collar (6F) may be retained in this radially expanded position, radially in sealing contact with the surrounding inner casing wall by means of an axial retainer ring (100), please see FIGS. 11*a* and 11*b* for details. The flange collar (6F) now forms a seal for constituting a foundation for cement later injected into the annulus above the flange collar (6F). The asymmetrically shaped flange collar now may support larger pressure from above than from below. If in the embodiment wherein the metal sleeve (6, 6*o*, 6*i*) is provided with one or more gasket sleeves (63*s*) on the surface or intermediate (63*i*) integrated with the metal sleeve, the sealing of the flange collar (6F) is improved.

FIG. 4 shows a ball being circulated down the drill pipe string, and closing in a ball seat in the shifting tool below its shift tool cementing port. Subsequently the plug (8) is blown out of the cementing port (12) by exerting fluid pressure via the conveying drill pipe string. Fluid communication with the casing section's (1) annulus is now established. Internally in the casing string the communication path is isolated by the tool string swab cups shown above and below the cementing port (12).

FIG. 5 shows cement being injected through the drill pipe string, leaving through the Cflex valve shift tool (3) pumping cement into the casing (1), and leaving the casing to the casing annulus through the now open cementing port (12). The annulus is filled to the desired degree with cement, which may be squeezed or not, according to the operator's desire.

FIG. 6 shows the shift tool (3) closing the valve sleeve (2) over the cementing port (12). Now the cement in the annulus is in place and must be left to settle and harden. The cement within the tool and part of the casing may be circulated out after closing the valve sleeve (2) using a bypass line past the swab cups of the cement tool (not shown here), so as for returning wash fluid and cementitious fluids back through the drill pipe string annulus within the casing (1). The bore through the casing will then be free of cement, please see FIG. 7.

FIG. 7 shows the result: The Cflex tool (3) has been released from the valve sleeve and pulled out of hole on its drillpipe string, the casing (1) annulus is now cemented above the flange collar; the casing bore is open for further operations.

FIG. 8 illustrates an embodiment of the deformable metal sleeve (6) having axially directed slots (65). The metal sleeve is doubled radially and arranged for the outer being tangentially shifted one half slot distance. The one is arranged within the other so as for together forming a tight barrier when axially compressed by the ring and expanded to a flange collar.

FIG. 9 illustrates the combined slotted sleeve (6, 6*a*, 6*b*) in original and expanded form. The slots are arranged interleaving so as for the expanded portions of metal between the slots together form a cement-proof support surface. In such an embodiment, the inner metal sleeve is deformed in concert with the outer metal sleeve and expand individually but maintain close contact.

FIG. 10 illustrates the combined slotted sleeve in part view and section (A), enlarged section (C) of (A), Section (B) as indicated in A-A in (A), enlarged section of (B), and a perspective view. In an embodiment of the invention a rubber layer (63*s*) may he arranged on the surface of the outer metal sleeve (6*b*) to improve the fluid proofing, please see lower right enlarged detail in FIG. 10. In another embodiment there may be an intermediate rubber layer (63*i*) arranged between the metal sleeves (6*a*, 6*b*), and in yet another embodiment there may be arranged a combination of the two: an inner metal sleeve (6*a*), an intermediate rubber layer (63*i*), an outer metal sleeve (6*b*), and an outer rubber layer (63*s*), please see lower left enlarged detail in FIG. 10. This may still form a slender package not building much on the outer face (11) of the casing section (1).

Each of the metal sleeves (6*a*, 6*b*) may be formed of ductile steel such as EN 10 130, 10 304 or 10 316. The thickness tested is 1 mm but in embodiments it may be increased to 1.25 mm or 1.50 mm. Important with regard to corrosion is that the material of the metal sleeves (6*a*, 6*b*) is lower on the corrosion scale than the base material of the cement valve as such. In use, the cementing sleeve device of the invention is installed together with the casing valve structure itself in a well, and activated for being used in a cementing process within a few days up to a month. When used, it must withstand the pressure of the cementing process for a period up to maximally 2 or 3 days when the cement has set and hardened, whereby the cementing sleeve has served its purpose.

The inner and outer rubber sleeves (63*i*, 63*s*) may have a thickness of 1-2 mm. The material of the rubber sleeves may be NBR: Nitride Butyl Rubber.

FIG. 11*a* comprises a cross section and a lateral view of a locking ring (100), please see FIGS. 3*b* and 11*b*, the locking ring (100) arranged for retaining the formed flange collar (6F) in position when axially compressed so as for maintaining the shape after having been expanded to contact the surrounding casing or borehole wall.

FIG. 11*b*: working and detail cross sections of the axially one-way lock ring (100). The lock ring (100) may be arranged between the fore end of the external sliding sleeve (5) and the acted-on first sleeve end (61) of the metal collar (6) to be axially compressed. The lock ring (100) is arranged slidable on the cylindrical smooth surface (11) of the casing section (1). When pushed along the direction to compress the metal collar (6) a four-sectioned locking ring (102*r*) or a set of locking balls (102*b*) in an inward facing recess (105) will be forced down an internal ramp surface (104) in the recess, the locking ring or balls (102*r*, 102*b*) compressing a resilient pre-tension ring (106), allowing unrestricted movement in the desired direction. When the force from the external sliding sleeve (5) is released, the locking ring or locking balls (102*r*, 102*b*) will due to possible hysteresis in the compressed flange collar (A) formed, up the ramp surface (104) and grip on the collar surface (11) and lock fast. This will retain the expanded flange collar (6F) in place when the inner sliding sleeve (2) is retracted to a closing position, bringing the external sliding sleeve (5) along and away from the expanded flange collar (6F). A significant advantage of having a lock ring (100) on a smooth surface (11) is that it ensures good fluid proof contact.

FIG. 12 illustrates an alternative axially one-way locking ring (200) with spring loaded lock dents to engage in a transverse groove sawtooth lock profile (202) on the outward surface (11). Also this is to be arranged between the fore end of the external sliding sleeve (5) and the engaged first sleeve end (61) of the metal collar to be axially compressed. The locking ring (200) is arranged slidable as for ring (100), and engages the transverse sawtooth groove lock profile when the acting force of the sliding sleeve (5) is released when it retreats. As the grooves are transverse, this also ensures good fluid proof contact.

The invention claimed is:

1. A casing annulus cement foundation system comprising:

a casing section comprising an internal sleeve arranged for being manipulated by a drill pipe string conveyed shift tool; and said drill pipe string conveyed shift tool exerting a force for translating said internal sleeve in an axial direction of said casing section, wherein said internal sleeve is provided with one or more radially directed bolts extending through corresponding axial-parallel slots through a casing wall of said casing section and fixed to a corresponding sliding casing-external sleeve, wherein said sliding casing-external sleeve abuts axially onto a first sleeve end of a deformable metal sleeve, the deformable metal sleeve being provided with an initial radial kink so as for forming a trace for which said radial kink may start developing under said axial compression of said deformable metal sleeve, said deformable metal sleeve being generally ductile, and non-resilient, so as to retain a deformed shape thereof when unloaded, wherein said deformable metal sleeve has a second sleeve end abutting onto an external ring shoulder on said casing section, and wherein said sliding casing-external sleeve is arranged for axially compressing said deformable metal sleeve so as for making a central portion between said first and second ends to expand by radial kinking to form a metal flange collar blocking said casing annulus, and wherein said sliding casing-external sleeve is configured to further deform the flange collar after the flange collar has encountered a surrounding casing wall, for further deformation to occur at the part of the deformed metal flange collar encountering the sliding casing-external sleeve.

2. The casing annulus cement foundation system of claim 1, wherein said deformable sleeve comprises an axial retainer ring arrangement along the outer wall of said casing section preventing axial displacement return from the activated position of said external sleeve.

3. The casing annulus cement foundation system of claim 1, comprising one or more cementing outlets through said casing section wall for cement ejection, said cementing outlets exposed by said internal sleeve when axially displaced, and closed when not axially displaced, so as for allowing cement to be ejected to said casing annulus.

4. The casing cement foundation system of claim 1, wherein said deformable sleeve comprises a set of coaxial sleeves.

5. The casing cement foundation system of claim 4, comprising an intermediate rubber sleeve between said inner and outer coaxial sleeve.

6. The casing cement foundation system of claim 1, wherein said deformable sleeve comprises a surface cover rubber sleeve for forming a gasket.

7. A method for forming a flange collar constituting a cement foundation in a casing annulus, comprising the steps of:

installing a casing section comprising an internal sleeve axially displaceable by a drill pipe string conveyed tool for opening a casing cementing outlet, said internal sleeve being connected through radial bolts through axial-parallel slots through a casing wall of said casing section to a casing-external sleeve, said casing-external sleeve abutting against a first edge of a deformable metal sleeve having its opposite, second end abutting axially against a radial shoulder on the casing section;

using said drill pipe string conveyed tool for axially displacing said internal sleeve thus forcing said external sleeve to deforming said metal sleeve to a radially extending flange collar radially extending across said casing annulus;

continuing moving said sliding casing-external sleeve thus further deforming the flange collar after the flange collar has encountered the surrounding casing wall, for further deformation to occur at a part of the deformed metal flange collar encountering the sliding casing-external sleeve;

ejecting cement via said casing cementing outlet to said annulus, allowing said cement to distribute above said formed radially extending flange collar, and allowing said cement to settle in said annulus;

after ejecting said cement through said cementing outlet, using said conveyed tool for displacing said internal sleeve thereby closing said cementing outlet; and circulating out excess cement within said internal sleeve and casing, and pulling said conveyed tool out of hole.

8. A method for forming a flange collar constituting a cement foundation in a casing annulus, comprising the steps of:

installing a casing section comprising an internal sleeve axially displaceable by a conveyed tool for opening a casing cementing outlet, said internal sleeve being connected through radial bolts through axial-parallel slots through a casing wall of said casing section to a casing-external sleeve, said casing-external sleeve abutting against a first edge of a deformable metal sleeve having its opposite, second end abutting axially against a radial shoulder on the casing section;

using said conveyed tool for axially displacing said internal sleeve thus forcing said external sleeve to deforming said metal sleeve to a radially extending flange collar radially extending across said casing annulus;

ejecting cement via said casing cementing outlet to said annulus, allowing said cement to distribute above said formed radially extending flange collar, and allowing said cement to settle in said annulus; and after ejecting said cement through said cementing outlet, using said conveyed tool for displacing said internal sleeve thereby closing said cementing outlet.

9. The method according to claim 8, further comprising circulating out excess cement within said internal sleeve and casing, and pulling said conveyed tool out of hole.

10. The method according to claim 8, wherein the conveyed tool is arranged on a drill pipe string.

11. The method according to claim 8, further comprising continuing moving said sliding casing-external sleeve thus further deforming the flange collar after the flange collar has encountered the surrounding casing wall, for further deformation to occur at a part of the deformed metal flange collar encountering the sliding casing-external sleeve.

* * * * *